US009058945B2

(12) United States Patent
Chou

(10) Patent No.: US 9,058,945 B2
(45) Date of Patent: Jun. 16, 2015

(54) ELECTRICAL SWITCH AND METHOD OF PRODUCING THE SAME

(71) Applicant: Tien-Ming Chou, Taichung (TW)

(72) Inventor: Tien-Ming Chou, Taichung (TW)

( * ) Notice: Subject to any disclaimer, the term of this patent is extended or adjusted under 35 U.S.C. 154(b) by 158 days.

(21) Appl. No.: 13/682,242

(22) Filed: Nov. 20, 2012

(65) Prior Publication Data

US 2014/0138219 A1 May 22, 2014

(51) Int. Cl.

| | |
|---|---|
| ***H01H 35/02*** | (2006.01) |
| ***H01H 35/00*** | (2006.01) |
| ***H01H 49/00*** | (2006.01) |

(52) U.S. Cl.

CPC ..... *H01H 35/00* (2013.01); *H01H 49/00* (2013.01); *Y10T 29/49105* (2013.01)

(58) Field of Classification Search

None

See application file for complete search history.

(56) References Cited

U.S. PATENT DOCUMENTS

| | | | | |
|---|---|---|---|---|
| 2,415,086 | A * | 2/1947 | Detwiler | 200/61.52 |
| 3,493,701 | A * | 2/1970 | Clarke | 200/61.45 R |
| 4,001,185 | A * | 1/1977 | Mitsui et al. | 200/61.45 R |
| 6,115,929 | A * | 9/2000 | Tanazawa et al. | 33/366.24 |
| 7,319,200 | B2 * | 1/2008 | Chou | 200/61.45 R |
| 7,323,649 | B2 * | 1/2008 | Chou | 200/61.45 R |
| 7,446,272 | B2 * | 11/2008 | Chou | 200/61.45 R |
| 7,563,997 | B2 * | 7/2009 | Chou | 200/61.45 R |
| 7,829,804 | B2 * | 11/2010 | Chou | 200/61.45 R |
| 2008/0017488 | A1 * | 1/2008 | Hong | 200/61.52 |
| 2008/0073194 | A1 * | 3/2008 | Chou | 200/52 R |
| 2009/0078546 | A1 * | 3/2009 | Chou | 200/61.52 |
| 2010/0133075 | A1 * | 6/2010 | Chou | 200/61.52 |

FOREIGN PATENT DOCUMENTS

| | | | |
|---|---|---|---|
| CN | 2777734 | Y | 5/2006 |
| CN | 101106037 | A | 1/2008 |
| CN | 102327949 | A | 1/2012 |
| CN | 202662474 | U | 1/2013 |
| JP | 2008-192602 | A | 8/2008 |

OTHER PUBLICATIONS

English Translation of Chinese Search Report, 2 pgs, Dec. 23, 2014.

* cited by examiner

*Primary Examiner* — Renee Luebke
*Assistant Examiner* — Ahmed Saeed
(74) *Attorney, Agent, or Firm* — McNees Wallace & Nurick LLC

(57) ABSTRACT

A method of producing an electrical switch which includes a rolling ball movable within a housing thereof to bridge and contact an array of pin terminals includes the steps of forming the pin terminals by using a punching process, wherein one or more smooth burr-free surfaces are formed on each of the pin terminals; and assembling the pin terminals, the housing and the rolling ball by spacing apart the pin terminals along a polygonal line and by arranging the smooth burr-free surfaces of the pin terminals to face toward each other substantially along diagonal lines such that the rolling ball contacts only the smooth burr-free surfaces when bridging the pin terminals.

1 Claim, 12 Drawing Sheets

ELECTRICAL SWITCH AND METHOD OF PRODUCING THE SAME

BACKGROUND OF THE INVENTION

1. Field of the Invention

The invention relates to a switch, and more particularly to an electrical switch and a method of producing the same.

2. Description of the Related Art

Referring to FIG. 1, a conventional rolling-ball switch 1 includes a housing 11, four metallic pin terminals 12 (only two is shown) arranged in an array and partially inserted into the housing 11, and a ball member 13 disposed in the housing 11 and contacting the pin terminals 12.

In normal use, the ball member 13 is simultaneously in contact with the pin terminals 12 to place the rolling-ball switch 1 in an ON state. When an external force is applied to the switch 1 so that the ball member 13 is moved away from one of the pin terminals 12, the switch 1 is shifted to an OFF state.

Referring to FIGS. 2 to 4, in combination with FIG. 1, during making of the pin terminal 12, a square-shaped blank 12' that extends along a long-axis direction (X) is formed by drawing or punching. Afterwards, a punch (not shown) is moved along a short-axis direction (Y) of the blank 12' to shear punch each corner 121' of the blank 12' consecutively by moving along a punching direction (C) toward a punching line 14, so that the pin terminal 12 is formed with four guide inclined sheared surfaces 121.

However, because each guide inclined sheared surface 121 is in contact with the punch during punching that causes a plastic deformation thereof, a roll over zone (I) having a smooth burr-free surface is formed. Afterwards, when bearing an external force that is lower than the tensile strength thereof, a shear zone (II) having a shiny surface is formed. Finally, when bearing an external force that is greater than the tensile strength thereof, a rupture/fracture zone (III) and a burr zone (IV) having surfaces that are approximately torn are formed.

Based on the aforesaid description, when each pin terminal 12 is assembled into the housing 11, because the fracture zone (II) and burr zone (IV) of the pin terminal 12 are rough and occupy a large area, they may scratch the housing 11 and provide a resistance during insertion of the pin terminal 12 into the housing 11. Furthermore, after assembly, the aforesaid rough surfaces, especially the burr zone (IV), may affect contact area with the ball member 13, so that efficiency of the conventional rolling-ball switch 1 is also affected.

SUMMARY OF THE INVENTION

Therefore, an object of the present invention is to provide an electrical switch and a method of producing the same that are capable of overcoming the aforesaid drawbacks of the prior art.

According to one aspect of this invention, a method of producing an electrical switch which includes a rolling ball movable within a housing thereof to bridge and contact an array of pin terminals comprises the steps of: forming the pin terminals by using a punching process, wherein one or more smooth burr-free surfaces are formed on each of the pin terminals; and assembling the pin terminals, the housing and the rolling ball by spacing apart the pin terminals along a polygonal line and by arranging the smooth burr-free surfaces of the pin terminals to face toward each other substantially along diagonal lines such that the rolling ball contacts only the smooth burr-free surfaces when bridging the pin terminals.

According to another aspect of this invention, an electrical switch comprises a housing, a polygonal array of pin terminals that are mounted to the housing and that have smooth burr-free surfaces facing towards each other along diagonal directions, and a rolling ball disposed movably inside the housing to bridge the pin terminals by contacting only the smooth burr-free surfaces of the pin terminals. The electrical switch is produced by a method which comprises: forming the pin terminals by using a punching process; and assembling the pin terminals, the housing and the rolling ball by spacing apart the pin terminals along a polygonal line and by arranging the smooth burr-free surfaces of the pin terminals to face toward each other substantially along diagonal lines.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
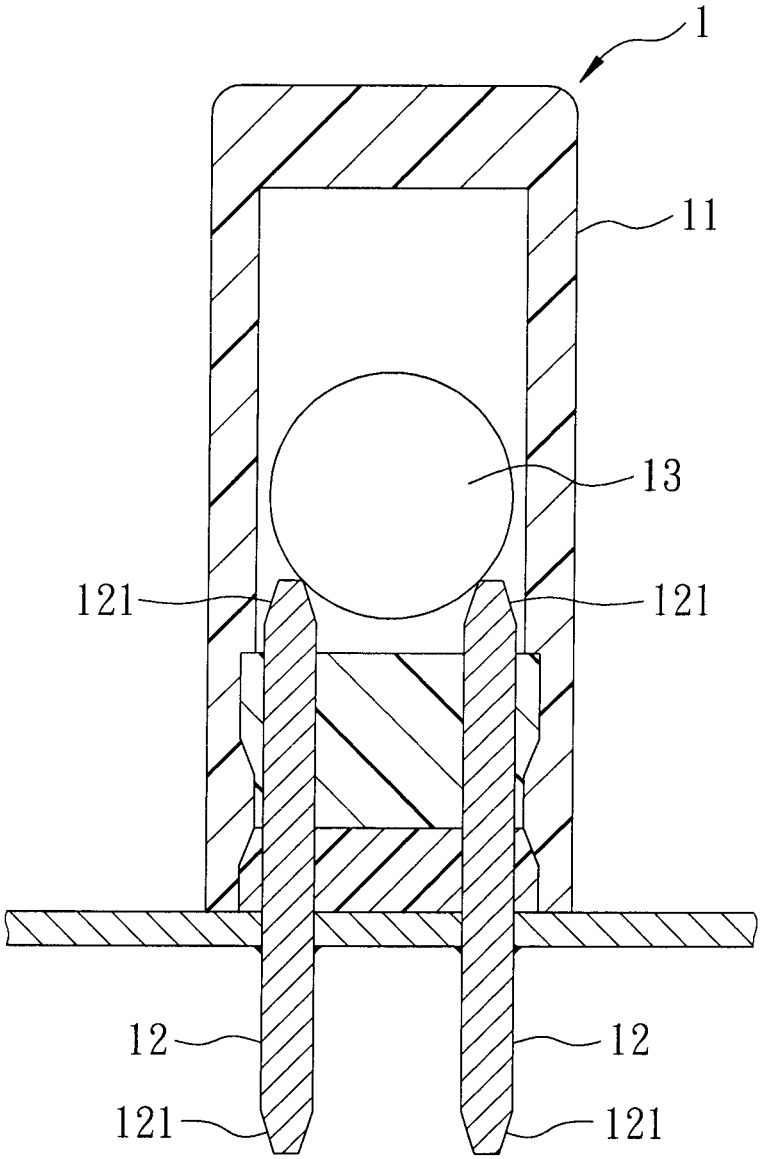
FIG. 1 PRIOR ART
FIG. 1 is a sectional view of a conventional rolling-ball switch.
Figure 2:
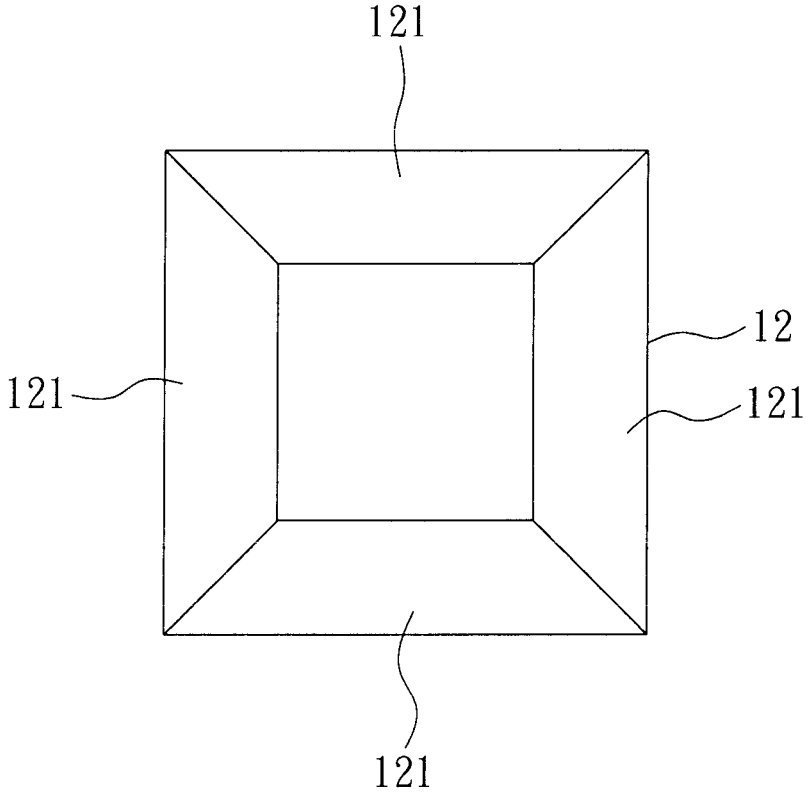
FIG. 2 PRIOR ART
FIG. 2 is a schematic top view of a pin terminal of the conventional rolling-ball switch.
Figure 3:
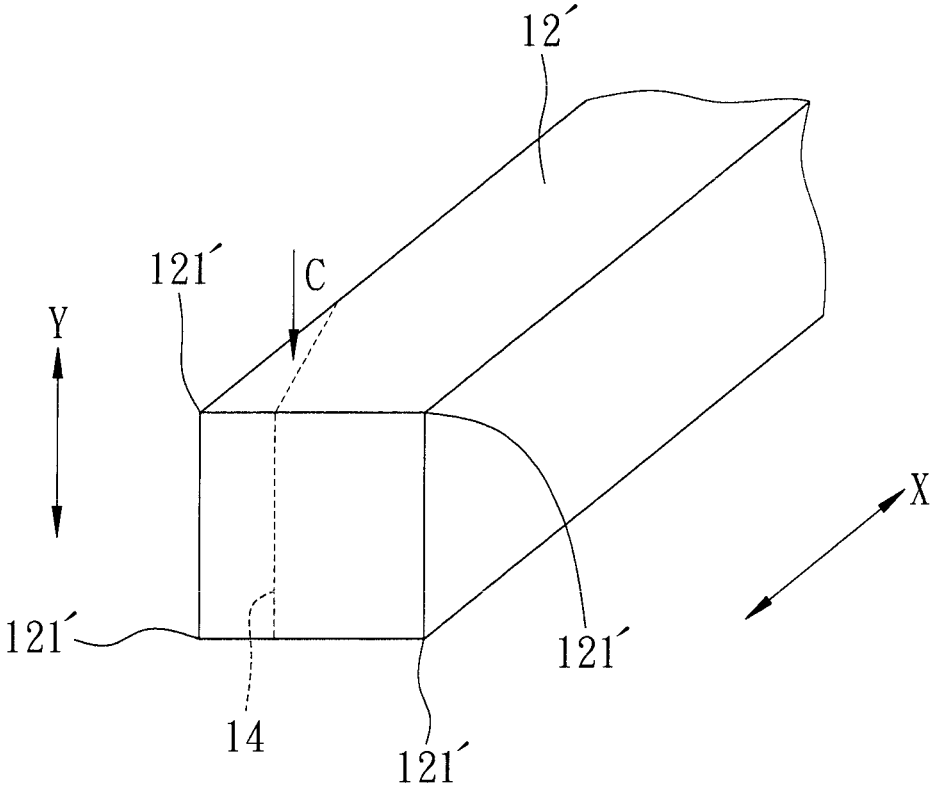
FIG. 3 PRIOR ART
FIG. 3 illustrates how the pin terminal of the conventional rolling-ball switch is formed.
Figure 4:
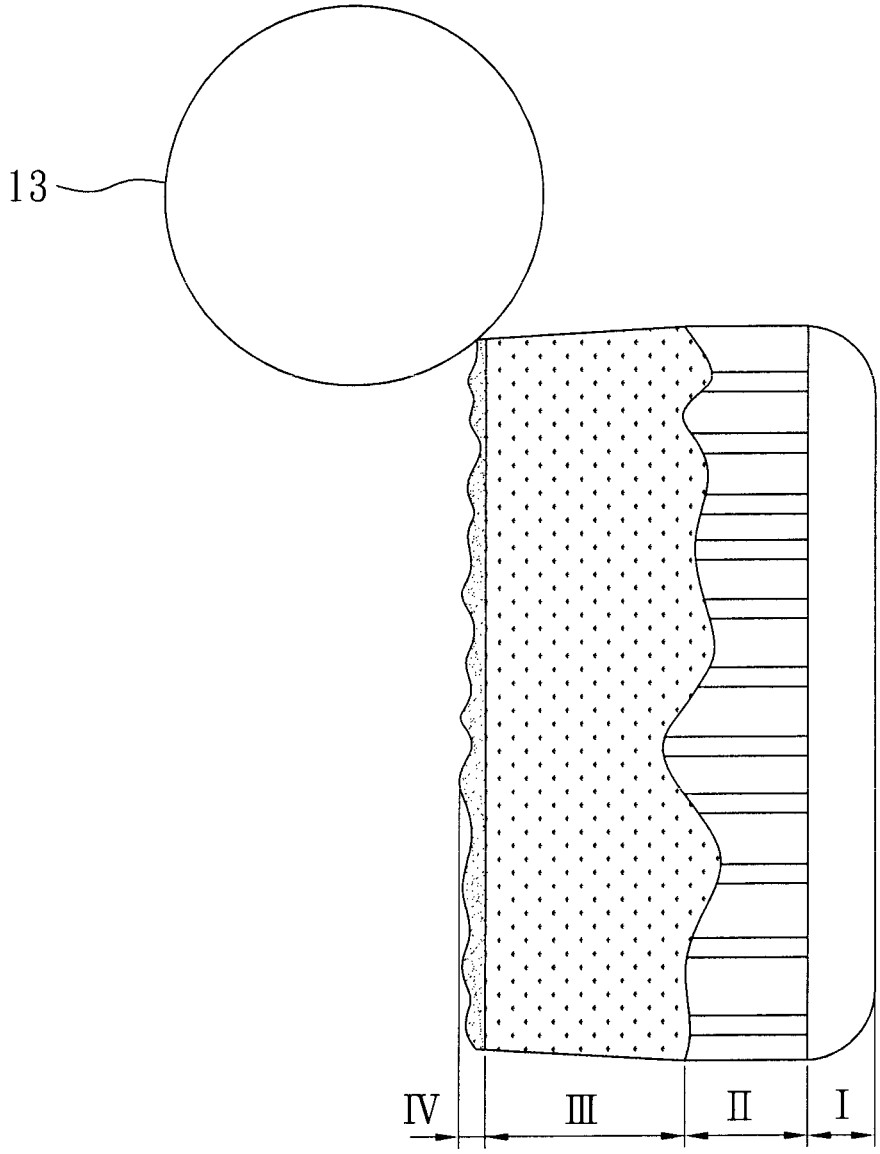
FIG. 4 PRIOR ART
FIG. 4 illustrates a burr zone of the pin terminal of the conventional rolling-ball switch in contact with a ball member.

Before the present invention is described in greater detail, it should be noted that the same reference numerals have been used to denote like elements throughout the specification.

Figure 5:
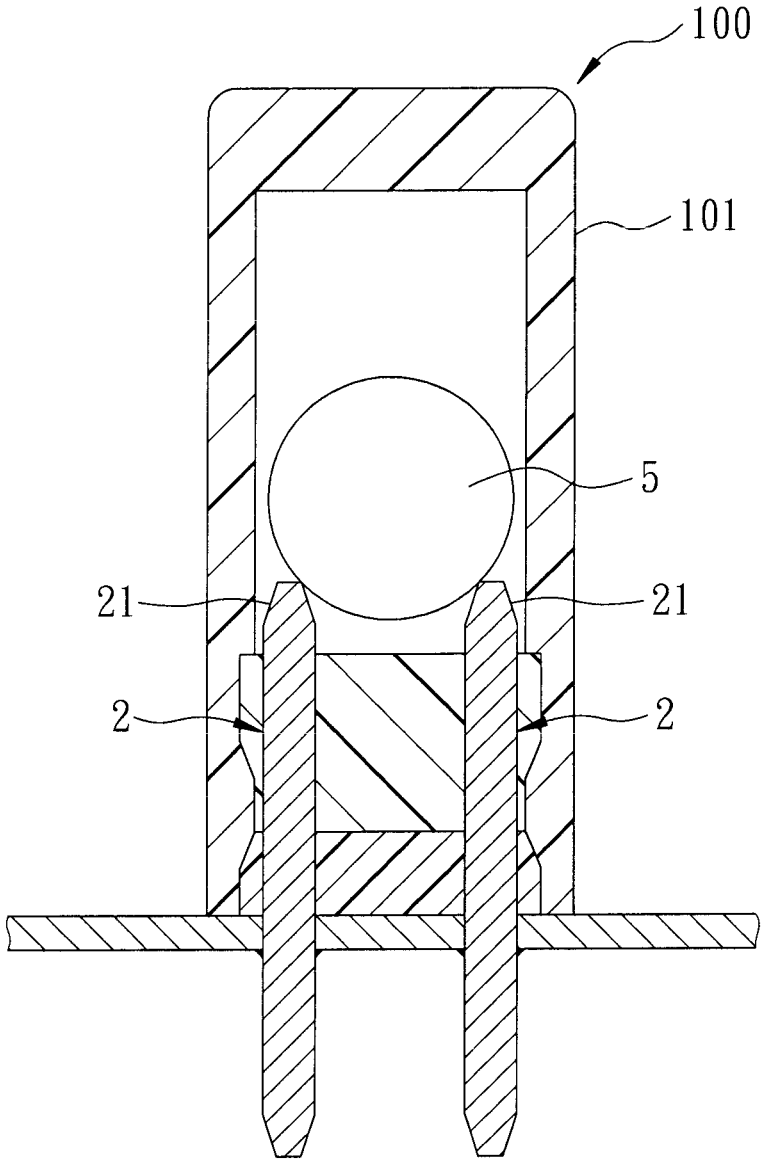
FIG. 5 is a sectional view of an electrical switch according to the first preferred embodiment of the present invention.
Figure 6:
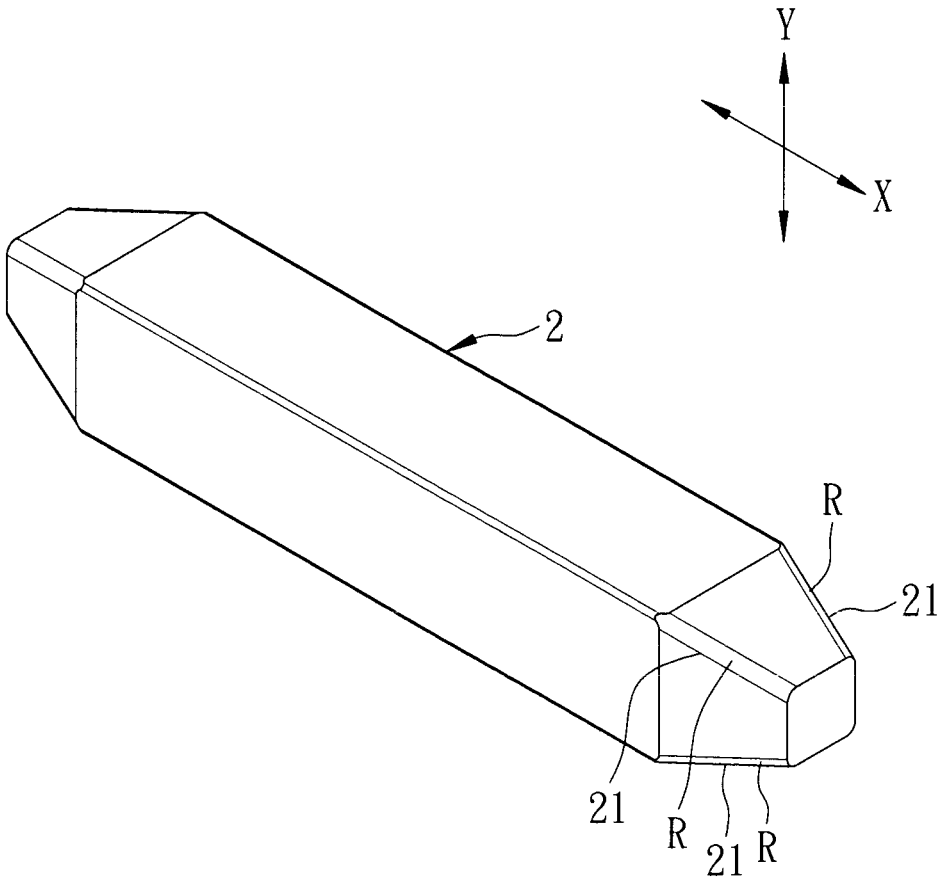
FIG. 6 is a perspective view of a pin terminal of the first preferred embodiment.

Referring to FIGS. 5 and 6, an electrical switch 100 according to the first preferred embodiment of the present invention comprises a housing 101, a polygonal array of pin terminals 2 (only two are shown in FIG. 5) that are mounted to the housing 101 and that have smooth burr-free surfaces (R) facing towards each other along diagonal directions, and a rolling ball 5 disposed movably inside the housing 101 to bridge the pin terminals 2 by contacting only the smooth burr-free surfaces (R) thereof.

A method of producing the electrical switch 100 comprises the steps of:

forming the pin terminals 2 by using a punching process, wherein one or more smooth burr-free surfaces (R) are formed on each pin terminal 2; and assembling the pin terminals 2, the housing 101 and the rolling ball 5 by spacing apart the pin terminals 2 along a polygonal line and by arranging the smooth burr-free surfaces (R) of the pin terminals 2 to face toward each other substantially along diagonal lines such that the rolling bail 5 contacts only the smooth burr-free surfaces (R) when bridging the pin terminals 2.

Since the structures of the pin terminals 2 are similar, only one pin terminal 2 will be described hereinafter. The pin terminal 2 extends along a long-axis direction (X), has a polygonal cross section, and includes two truncated pyramidal shaped end portions oppositely spaced apart from each other along the length of the pin terminal 2. Each truncated pyramidal shaped end portion has four converging pyramidal corners 21. Each pyramidal corner 21 is a rounded corner that has the smooth burr-free surface (R). Each smooth burr-free surface (R) has a width (t) (see FIG. 8) smaller than a cross sectional width (T') (see FIG. 8) of the pin terminal 2 along a short-axis direction (Y).

Figure 7:
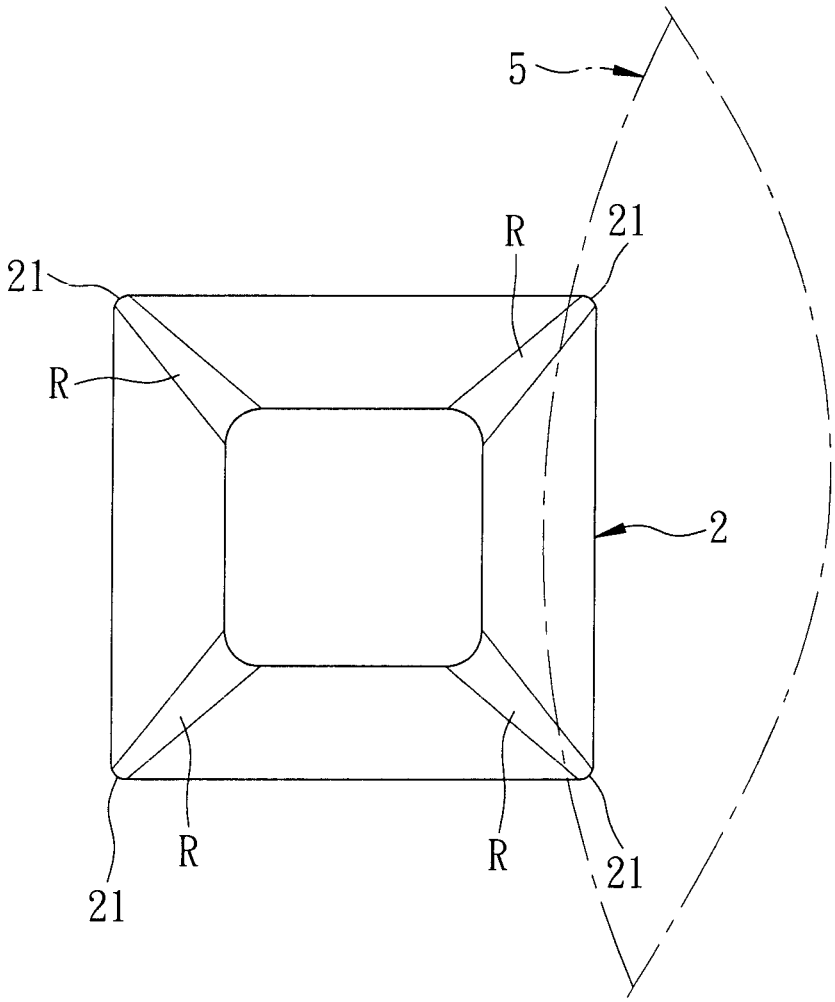
FIG. 7 is a schematic top view of the pin terminal of the first preferred embodiment.
Figure 8:
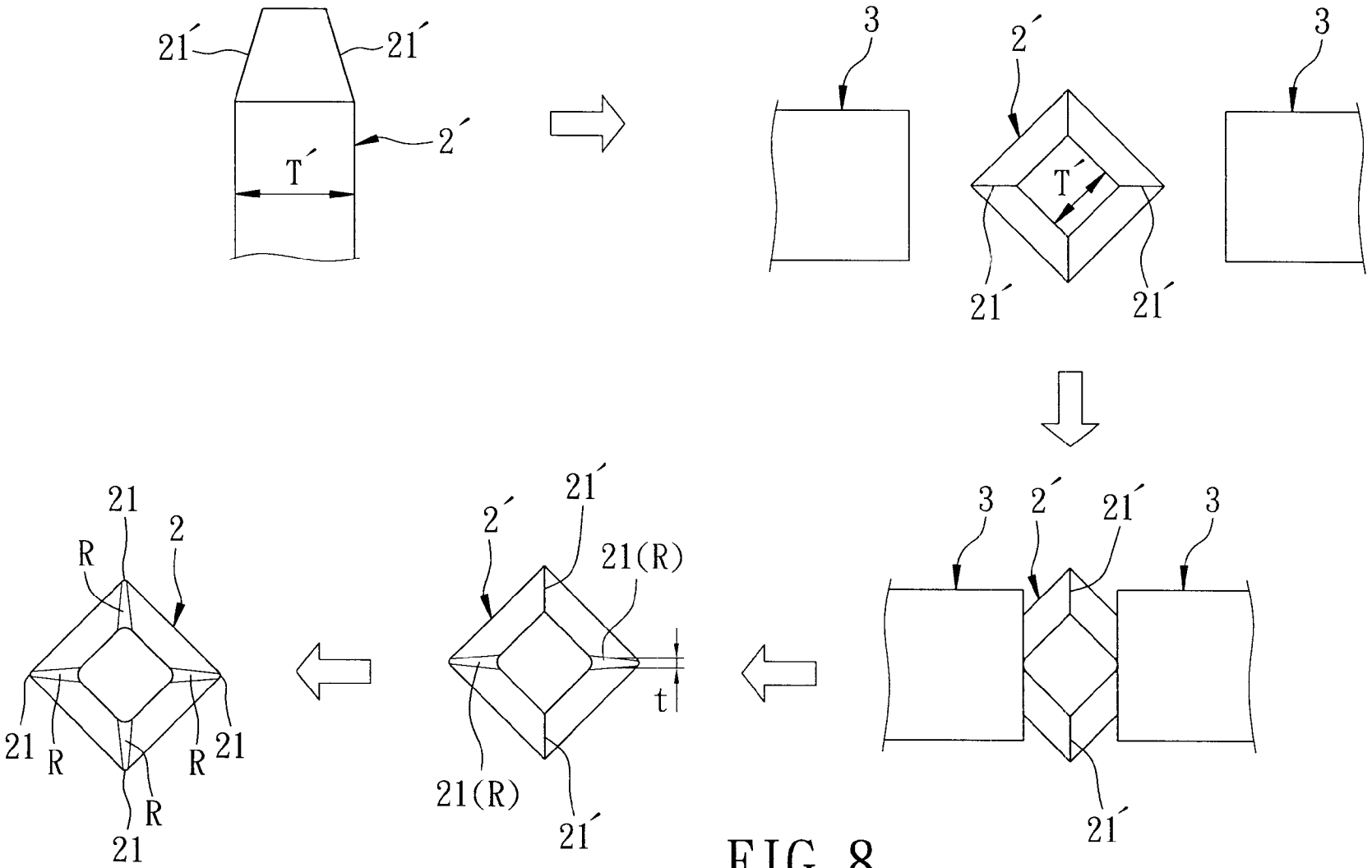
FIG. 8 illustrates how the pin terminal of the first preferred embodiment is formed.
Figure 9:
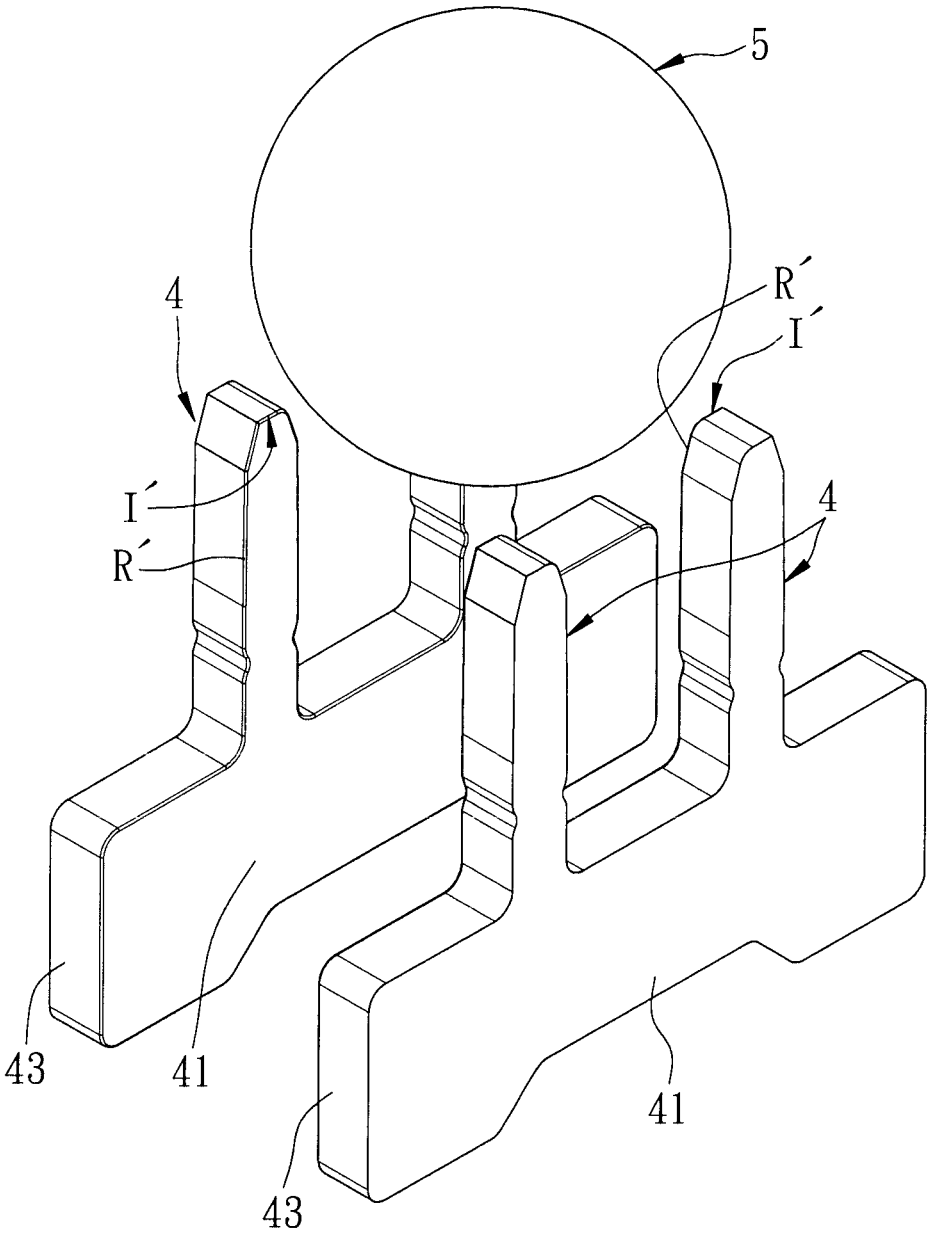
FIG. 9 is a perspective view of pin terminals and a rolling ball of an electrical switch according to the second preferred embodiment of the present invention.

Referring to FIGS. 7 and 8, the forming of the pin terminals 2 includes the steps of:

preparing rod materials 2' (only one is shown in FIG. 8) each extending along the long-axis direction (X) and having a polygonal cross section;

shear punching each of the rod materials 2' to form at least one end portion;

shear punching the end portion to form the end portion into a truncated pyramidal shaped end portion having a square base;

disposing two opposite corners 21' of the end portion between two punches 3, each of the punches 3 having a shape matching that of the corners 21';

operating the punches 3 to strike the two opposite corners 21' so that the corners 21' are respectively formed with smooth burr-free surfaces (R);

disposing the other two opposite corners 21' of the truncated pyramidal shaped end portion between the two punches 3; and operating the punches 3 to strike the other two opposite corners 21' so that the corners 21' are respectively formed with smooth burr-free surfaces (R).

It is worth mentioning that after punching the two opposite corners 21' of the truncated pyramidal shaped end portion, the rod material 2' is rotated to an angle of 90° so as to punch the other two opposite corners 21' of the truncated pyramidal shaped end portion. Alternatively, two pairs of punches 3, which are disposed perpendicular to each other, may be used in this embodiment. The pairs of punches 3 are operated one after the other to punch each two opposite corners 21' of the rod material 2'.

FIGS. 9 to 12 illustrate pin terminals 4 of the electrical switch according to the second preferred embodiment of this invention. In this embodiment, the forming of the pin terminals 4 includes the steps of:

preparing a thin plate material 4';

disposing the plate material 4' on a punch device 3; and operating the punch device 3 to shear punch the plate material 4' so as to form a plurality of the pin terminals 4.

Figure 10:
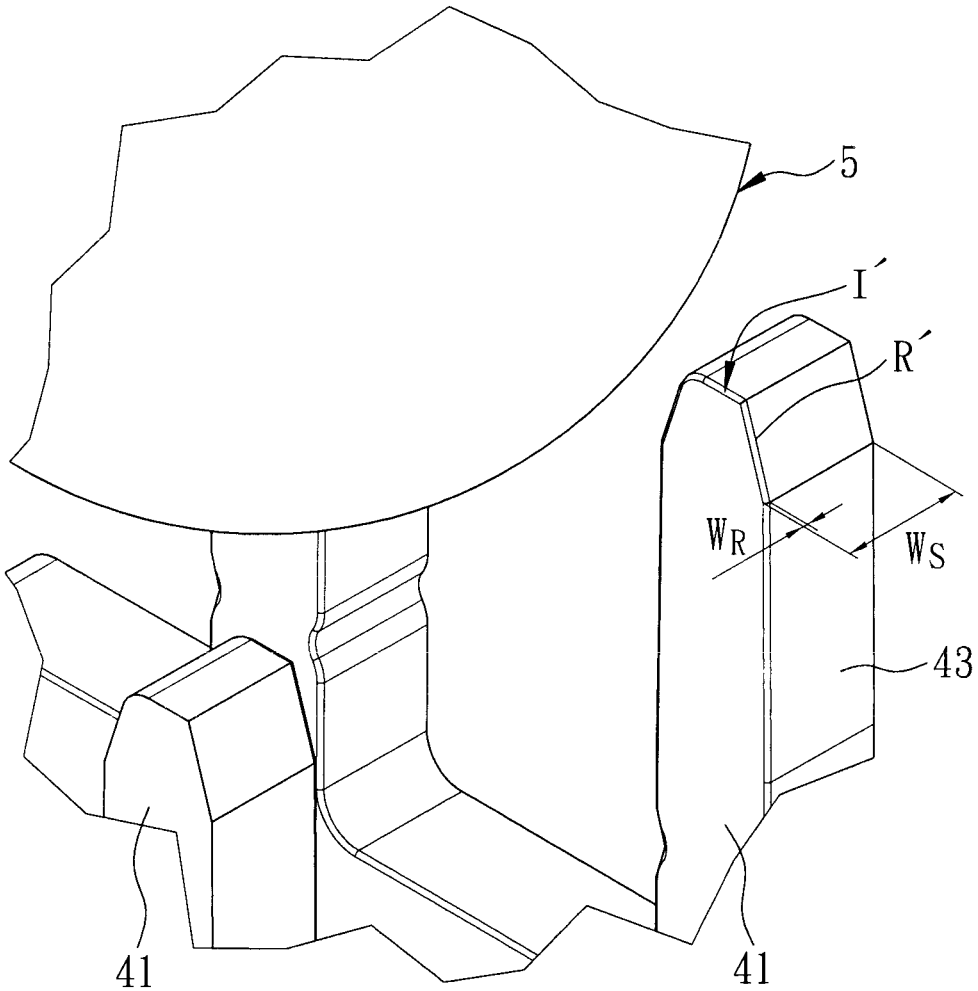
FIG. 10 is a fragmentary enlarged perspective view of the pin terminals and the rolling ball of the second preferred embodiment.
Figure 11:
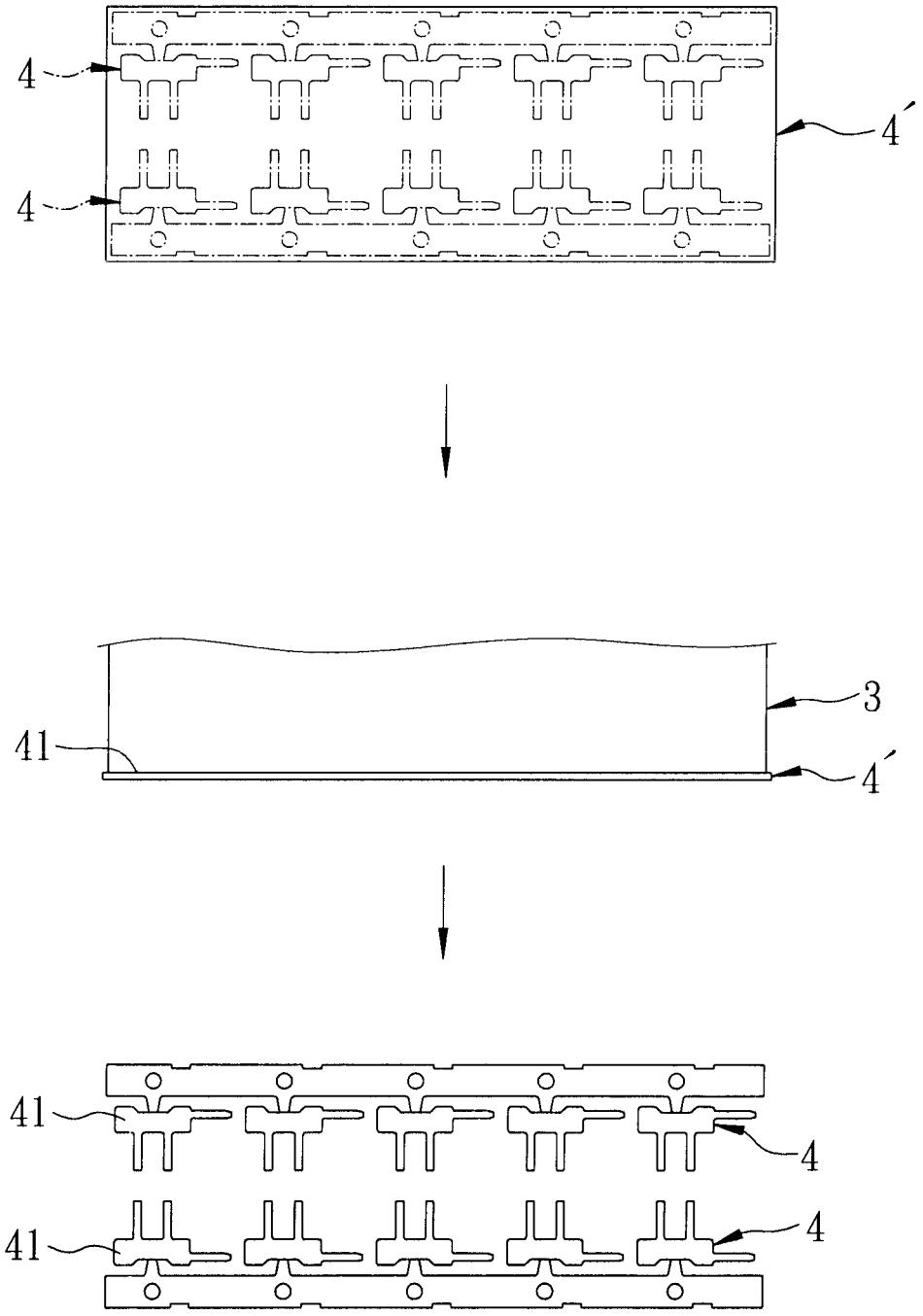
FIG. 11 illustrates how the pin terminals of the second preferred embodiment are formed.
Figure 12:
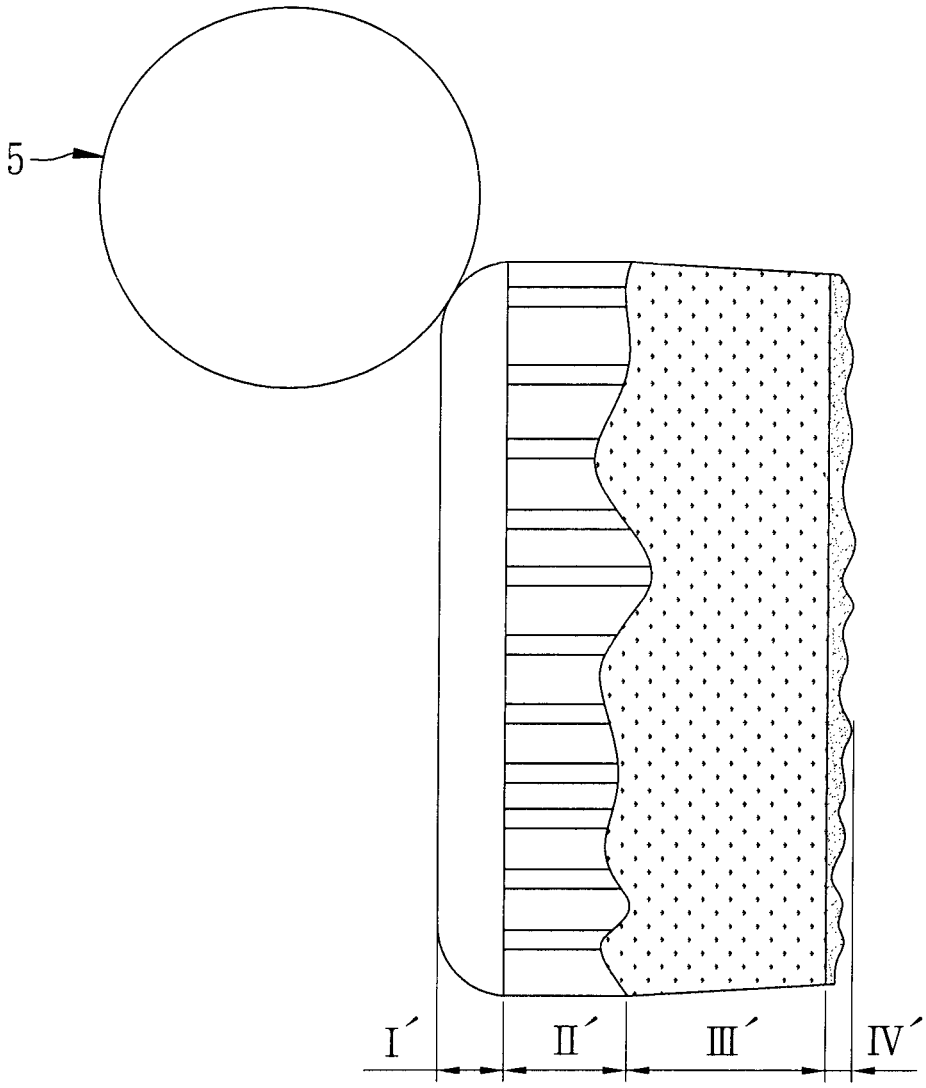
FIG. 12 illustrates the rolling ball in contact with a roll over zone of the pin terminal.

Each of the pin terminals 4 has a plate surface 41 stricken by the punch device 3, and a sheared face 43 sheared by the punch device 3. The sheared face 43, during contact with the punch device 3, is sequentially formed with a rollover zone (I'), a shear zone (II'), a fracture zone (III') and a burr zone (IV'), as shown in FIG. 12. The roll over zone (I') is formed at the sheared face 43 adjacent to and extending around the plate surface 41, and has a smooth burr-free surface (R'). Further, the roll over zone (I') has a width ($W_R$) smaller than a width ($W_S$) of the sheared face 43, as shown in FIG. 10.

It is worth mentioning that to enhance the processing speed, during punching of the thin plate material 4', a mirror image punch is applied to form two rows of pin terminals 4. During assembly, the roll over zones (I') of the pin terminals 4 are disposed to face each other, so that, after assembly, the rolling ball 5 can only contact the smooth burr-free surfaces (R') of the roll over zones (I') of the pin terminals 4.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An electrical switch comprising a housing, a polygonal array of pin terminals that are mounted to the housing and that have smooth burr-free surfaces facing towards each other along diagonal directions, and a rolling ball disposed movably inside the housing to bridge the pin terminals by contacting only the smooth burr-free surfaces of the pin terminals, wherein the electrical switch is produced by a method which comprises:

forming the pin terminals by using a punching process; and assembling the pin terminals, the housing and the rolling ball by spacing apart the pin terminals along a polygonal line and by arranging the smooth burr-free surfaces of the pin terminals to face toward each other substantially along diagonal lines;

wherein each of the pin terminals has a polygonal cross section, and includes at least one truncated pyramidal shaped end portion that has converging pyramidal corners, each of the pyramidal corners being a rounded corner that has the smooth burr-free surface.

* * * * *